US005165708A

United States Patent [19]

I-Chuan

[11] Patent Number: 5,165,708

[45] Date of Patent: Nov. 24, 1992

[54] DOUBLE-FOOT PLATE PEDALING SKATE

[76] Inventor: Chan I-Chuan, 2F, No. 34-1, Hwa Shing St., Panchiao City, Taipei Hsien, Taiwan

[21] Appl. No.: 751,065

[22] Filed: Aug. 28, 1991

[51] Int. Cl.[5] ..... A63C 17/02; A63C 17/26

[52] U.S. Cl. ..... 280/11.115; 280/11.19; 280/11.27; 74/560; 74/594.4; 301/112; 301/121

[58] Field of Search ..... 280/11.115, 11.19, 11.22, 280/11.27, 7.13, 7.14, 7.15, 200; 301/111, 112, 118, 121, 126, 131; 74/512, 560, 561, 562, 594.6, 594.4

[56] References Cited

U.S. PATENT DOCUMENTS

| | | | |
|---|---|---|---|
| 282,156 | 7/1883 | Burton | 280/11.27 X |
| 2,724,867 | 11/1955 | Smith | 301/112 X |
| 3,035,854 | 5/1962 | Johnston | 280/11.115 X |
| 4,515,382 | 5/1985 | Boese | 280/11.115 X |
| 4,786,068 | 11/1988 | Tang | 280/11.115 X |
| 4,955,669 | 9/1990 | Jankevics | 301/111 X |

FOREIGN PATENT DOCUMENTS 1505849 4/1969 Fed. Rep. of Germany ..... 301/111

*Primary Examiner*—Andres Kashnikow
*Assistant Examiner*—Brian L. Johnson
*Attorney, Agent, or Firm*—Bacon & Thomas

[57] ABSTRACT

A double-foot plate pedaling skate, comprising two foot plates alternatively pedaled to force three sets of wheels to run. The three sets of wheels include a first set of wheels mounted on the wheel axles of one foot plate at one side, a second set of wheels mounted on the wheel axles of the other foot plate at the opposite side, and a third set of wheels respectively secured to and retained between the two food plates permitting the two foot plates to be alternatively disposed at two different angular positions at 180° from each other so that the two foot plates can be alternatively pedaled to provide axle and wheel rotation.

2 Claims, 5 Drawing Sheets

DOUBLE-FOOT PLATE PEDALING SKATE

BACKGROUND OF THE INVENTION

The present invention relates to a pedaling skate and relates more particularly to such a pedaling skate which has two foot plates mounted on a plurality of small wheels at 180° from each other and alternatively pedaled to force said small wheels to run.

According to the known structure, a roller skate is generally comprised of a foot plate mounted on two or four small wheels for skating on a hard smooth surface. The present invention provides an improved skate structure which is driven to move smoothly over a hard smooth surface by means of pedaling two foot plates alternatively.

SUMMARY OF THE INVENTION

According to the present invention, a double-foot plate pedaling skate is generally comprised of three pairs of small wheels and two foot plates. The two foot plates each have two wheel axles transversely secured at the bottom by clamps for holding the small wheels. The three pairs of small wheels include a first pair attached to the two wheel axles of the first foot plate at one end, a second pair attached to the wheel axles of the second foot plate at one end, and a third pair attached to the two wheel axles of the first as well as the second foot plate at the opposite end respectively. Therefore, the first and second foot plates can be alternatively pedaled to provide axle and wheel rotation.

DETAILED DESCRIPTION OF THE PREFERRED EMBODIMENT

Figure 1:
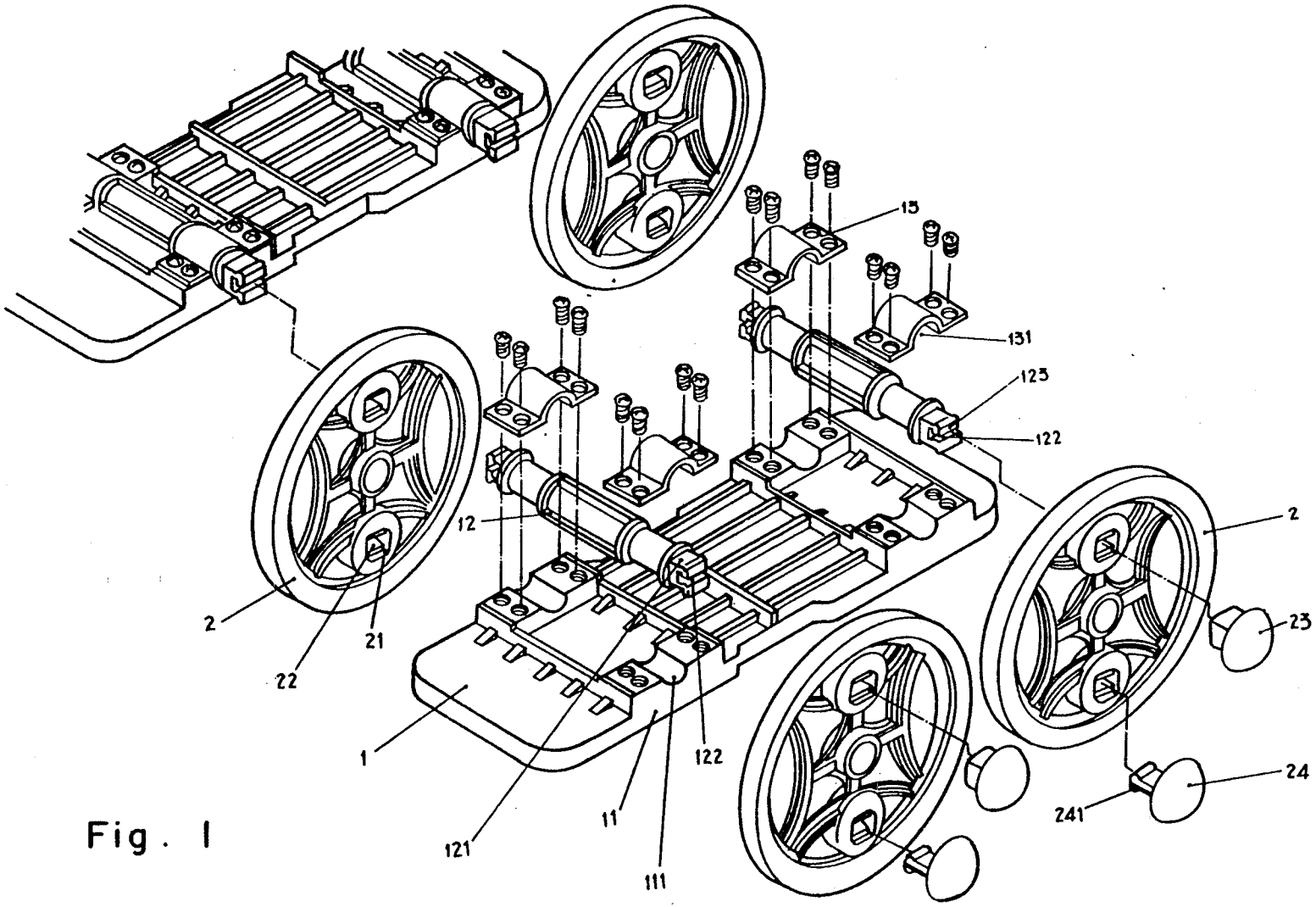
FIG. 1 is an exploded perspective view of the preferred embodiment of the present invention.
Figure 2:
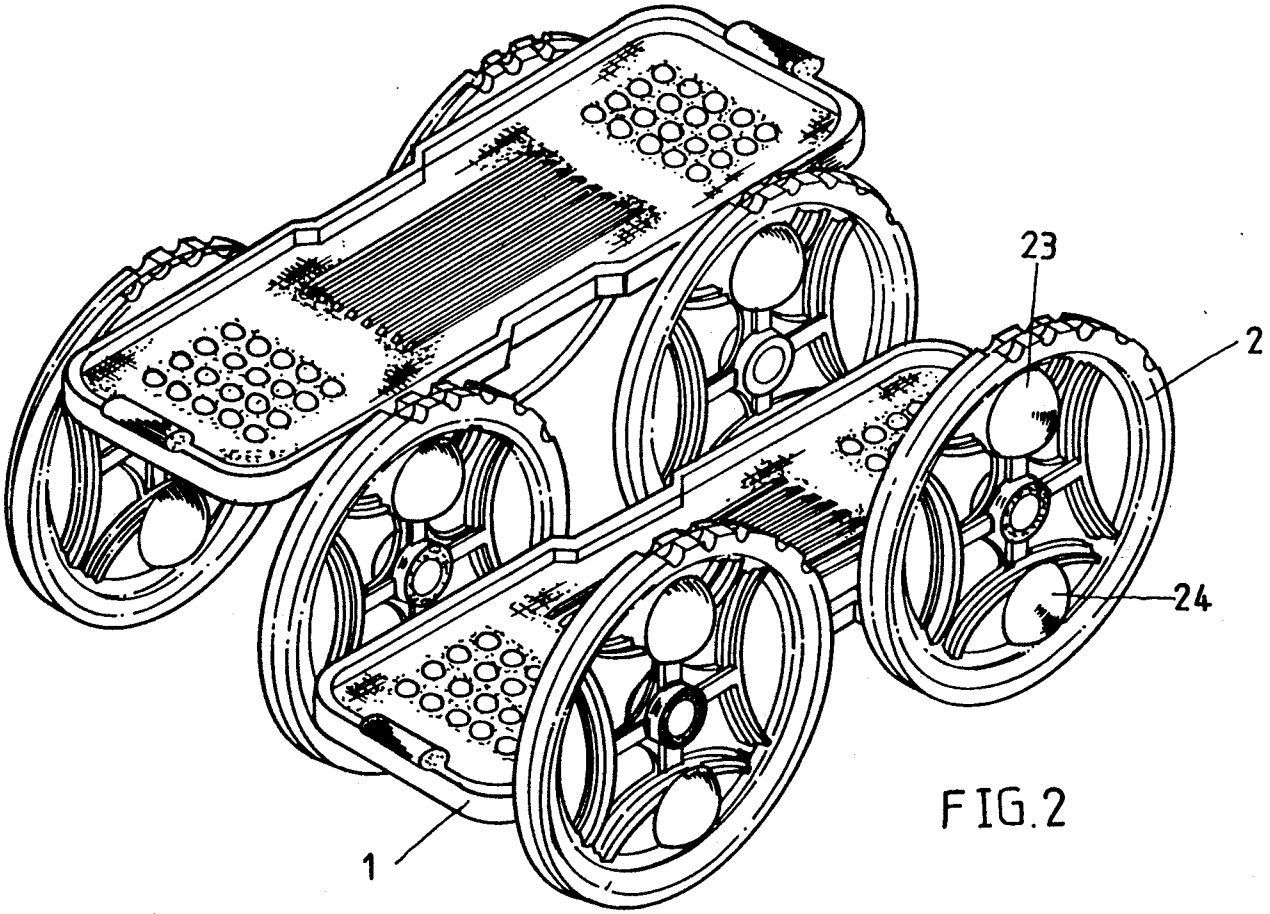
FIG. 2 is a perspective assembly view thereof.
Figure 3:
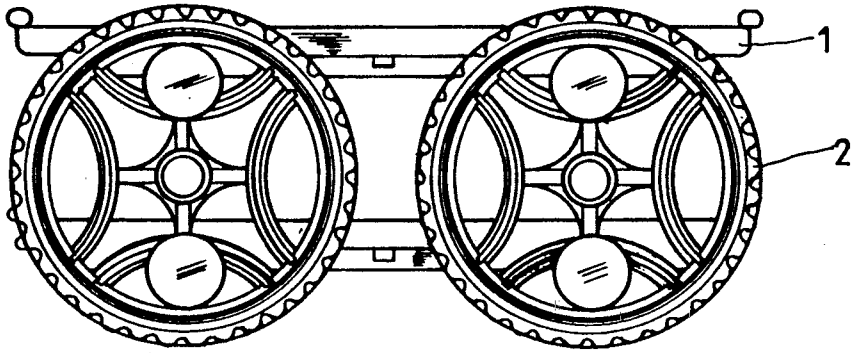
FIGS. 3 through 5 illustrates the alternating motion of the two food plates thereof.
Figure 4:
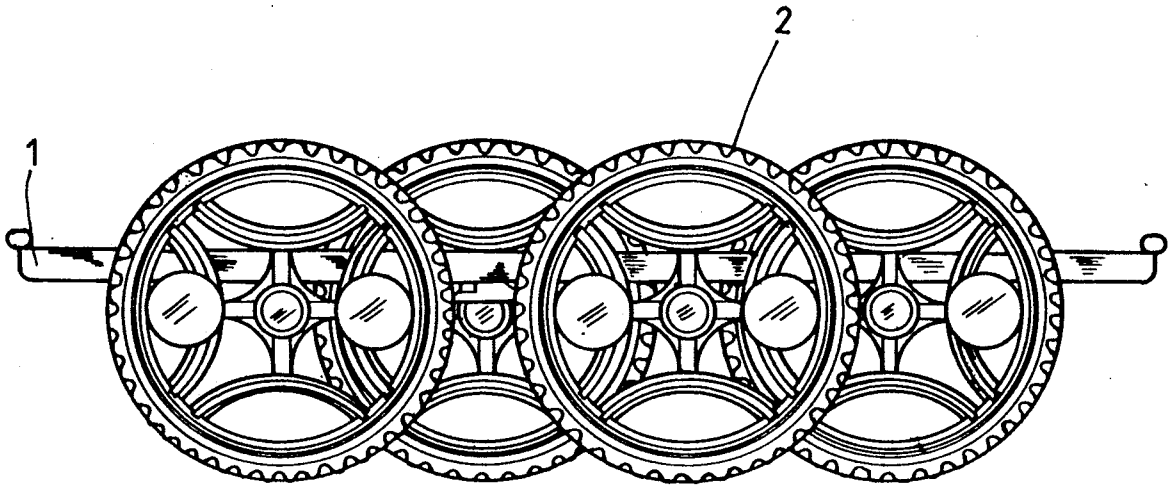
Figure 5:
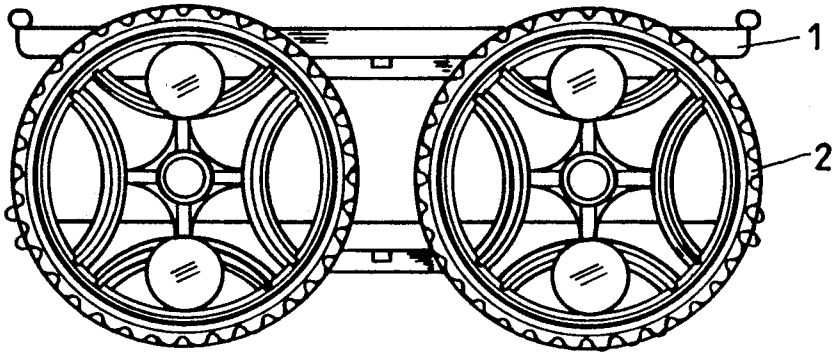

Referring to the annexed drawings in detail, therein illustrated is the preferred embodiment of the double-foot pate pedaling skate of the present invention, which is generally comprised of two foot plates 1 and three pair of wheels 2.

Each foot plate 1 has two axle seats 11 transversely made on the bottom edge thereof at two opposite ends each of which defining therein two elongated grooves 111 longitudinally aligned at two opposite ends for holding a wheel axle 12 by two clamps 13. Each clamp 13 defines therein a groove 131 and is attached to either axle seat 11 at either end to incorporate with the groove 111 thereon for holding a wheel axle 12 in place. Each wheel axle 12 has two square blocks 121 at two opposite ends, each of which has a forked terminal end 122 with two raised portions 123 made thereon at two opposite sides.

Each wheel 2 has two square holes 21 symmetrically disposed at two eccentric locations each of which has two raised blocks 22 at the inside at two opposite locations. By inserting either square block 121 of either wheel axle 12 in either square hole 21 on either wheel 2 permitting the two raised portions 122 on the forked terminal end 122 thereof to engage with the two raised blocks 22 in said square hole 21, the wheels 2 can be respectively mounted on the wheel axles 12 at two opposite ends.

During assembly process, one pair of the wheels 2 are connected between the two foot plates 1 with the two square holes 21 of each wheel 2 respectively connected to either wheel axle 12 on either foot plate, and the other two pairs of wheels 2 are respectively connected to the two wheel axles 12 of the two foot plates 1 at the opposite ends respectively. After assembly, the three pairs of wheels 2 are vertically disposed at the same level while the two foot plates 1 are respectively disposed at different angular positions at 180° from each other. Therefore, the two foot plates 1 can be alternatively pedaled to force the wheels 2 to rotate through axle rotation. Further, there are provided two different ornament caps 23 and 24 for sealing the two square holes 21 on each wheel 2. The first ornament cap 23 has a square rod extending from the head thereof for inserting in the square hole 21 into which the forked terminal end 122 of either wheel axle 12 is inserted. The second ornament cap 24 has a forked rod extending from the head thereof for inserting in the square hole 21 which remains in blank.

What is claimed is:

1. A double-foot plate pedaling skate, comprising two foot pates mounted on a plurality of sets of wheels and alternatively pedaled to provide wheel rotation, said foot plates each having a plurality of axle seats transversely disposed on the bottom edge thereof at two opposite ends each of which define therein an elongated groove for rotatably holding a wheel axle by clamps secured to said foot plate bottom edge, said wheel axle having two square blocks at two opposite ends each of which having a forked terminal end with two raised portions made thereon at two opposite sides; said wheels each having two square holes symmetrically disposed at two eccentric locations, said square holes each having two raised blocks at an inside surface at two opposite locations, said wheels being respectively mounted on said wheel axles at two opposite ends by inserting each square block at either end on either of said wheel axles in either of said square holes on either of said wheels permitting said two raised portions to engaged with said two raised blocks.

2. The double-foot plate pedaling skate of claim 1 wherein said plurality of sets of wheels include a first set of wheels secured to one foot plate at one side, a second set of wheels secured to the other foot plate at the opposite side and a third set of wheels respectively secured to and retained between said two foot plates, the two square holes on each of said third set of wheels being respectively connected to a corresponding wheel axle on each foot plate permitting said two foot plates to be alternatively disposed at two different angular positions at 180° from each other for alternate pedalling motion to rotate the wheels.

* * * * *